United States Patent [19]

Gundlach et al.

[11] Patent Number: 4,558,221

[45] Date of Patent: Dec. 10, 1985

[54] SELF LIMITING MINI-COROTRON

[75] Inventors: Robert W. Gundlach, Victor; Richard F. Bergen, Ontario, both of N.Y.

[73] Assignee: Xerox Corporation, Stamford, Conn.

[21] Appl. No.: 490,825

[22] Filed: May 2, 1983

[51] Int. Cl.[4] ..... G03G 15/00

[52] U.S. Cl. ..... 250/325

[58] Field of Search ..... 250/325, 326, 324

[56] References Cited

U.S. PATENT DOCUMENTS

| | | | |
|---|---|---|---|
| 2,836,725 | 5/1958 | Vyverberg | 250/49.5 |
| 3,688,107 | 8/1972 | Schneider et al. | 250/49.52 C |
| 3,813,547 | 5/1974 | Silverberg | 250/324 |
| 3,900,735 | 8/1975 | Jahn | 250/324 |
| 3,912,989 | 10/1975 | Watanabe et al. | 317/262 A |
| 4,100,411 | 7/1978 | Davis | 250/324 |
| 4,110,024 | 8/1978 | Gundlach | 355/3 TR |
| 4,112,299 | 9/1978 | Davis | 250/326 |

FOREIGN PATENT DOCUMENTS 2013133A 8/1979 United Kingdom .

*Primary Examiner*—Bruce C. Anderson
*Assistant Examiner*—Paul A. Guss
*Attorney, Agent, or Firm*—William A. Henry, II

[57] ABSTRACT

A minaturized self limiting corona generator for charging a receiver surface includes a plurality of corona emitting wires housed in respective biased conductive shields with the wires being spaced farther from the receiver surface than the wire-to-shield spacing in order to provide self limiting of surface potential on the receiver surface.

9 Claims, 2 Drawing Figures

SELF LIMITING MINI-COROTRON

Reference is hereby made to copending application Ser. No. 390,824, entitled "Mini-Corotron" in the name of Richard Frank Bergen filed concurrently herewith.

This invention relates to an inexpensive, compact and powerful corona generator capable of producing a uniform output for charging a surface.

More specifically, this invention relates to an electrical corona generator capable of producing a highly efficient discharge and is thus well suited to effectively charge a receiving surface such as a photosensitive member or the like.

Many methods and devices have been disclosed in the prior art for producing a uniform electrostatic charge upon a photosensitive member. One such charging device is disclosed by Vyverberg in U.S. Pat. No. 2,836,725, issued May 27, 1958, wherein an electrode in the form of a wire surrounded by an electrically grounded conductive shield is placed adjacent to a grounded receiving surface and a high voltage source connected to the wire wherein a corona discharge is produced. A corona discharge is produced when the generator is placed in close proximity to the photosensitive member and a voltage applied to the generator of sufficient magnitude to cause a breakdown of the ions in the air within the separating gap. As a result, charged ions are formed around the corona generator flow to the grounded photosensitive member surface and are deposited thereon to raise the surface potential to a relatively high level.

In the art of xerography, it has been found that consistent reproductive quality can only be maintained when a uniform and constant charge potential is applied to the photoconductive surface. In many automatic machines of this type, a single wire generator, generally referred to as a "corotron" is employed. Generally, the efficiency of the corotron is dependent on many factors including the gap distance between the wire and the photosensitive member surface, the nature of the generating wire material, the diameter of the wire and other physical features thereof and the amount of energy supplied to the corona emitter. Heretofore, these corona devices required large power supplies to meet high current and voltage requirements, were costly and took up a large area of machine space. Such units are designed for use with thin (0.0035") wire or wires located approximately ½" from a grounded photosensitive member or shield. Typically, corona wire voltages for charging are near 7 KV with a base receiver current of 22 μA for a 15" long wire (1.5 μA/in). The cross sectional area of such a unit is near 1 inch square. These units were sufficient in the past, but with present need for copiers that produce more uniformally charged surface, use less energy, are less costly and take up less space, charges in corona generating devices are required. This was thought to be impossible because conventional thinking on corona generators and experience had taught that reducing the cavity partly surrounding the corotron and bringing the corotron closer to a receiver surface would cause arcing to occur and burn out the wire corotron. Despite the conventional teachings to the contrary, the present invention includes a small mini-corona generating device that is self limiting, energy efficient, useful in confined spaces and charges over a narrow region instead of a spread out area. Heretofore, the control of surface potential on the receptor surface was possible only with scorotrons as in U.S. Pat. Nos. 3,688,107 and 3,062,956 or lipped corotrons where the control electrodes extended or were interposed between the corona wire and the charge receiving surface.

Accordingly, in one aspect of the present invention, there is provided a minaturized apparatus for charging a photosensitive surface with self limiting control of receptor potential which includes a corona generating wire, a source of electrical energy being operatively connected to the generating wire to cause the wire to emit a corona discharge, the wire generator being constructed with a 0.0015 to 0.002" diameter wire, spaced approximately 1/16" from a biased conductive shield and approximately ¼" from the photosensitive surface and requiring only a minature power supply.

In another aspect of the present invention, a mini-corotron is disclosed that provides a lower potential source with scoroton like characteristics of limiting surface potential.

The foregoing and other features of the instant invention will be more apparent from a further reading of the specification and claims and from the drawings in which:

While the invention will be described hereinafter in connection with a preferred embodiment, it will be understood that it is not intended to limit the invention to that embodiment. On the contrary, it is intended to cover all alternatives, modification and equivalents as may be included within the spirit and scope of the invention as defined by the appended claims.

Figure 1:
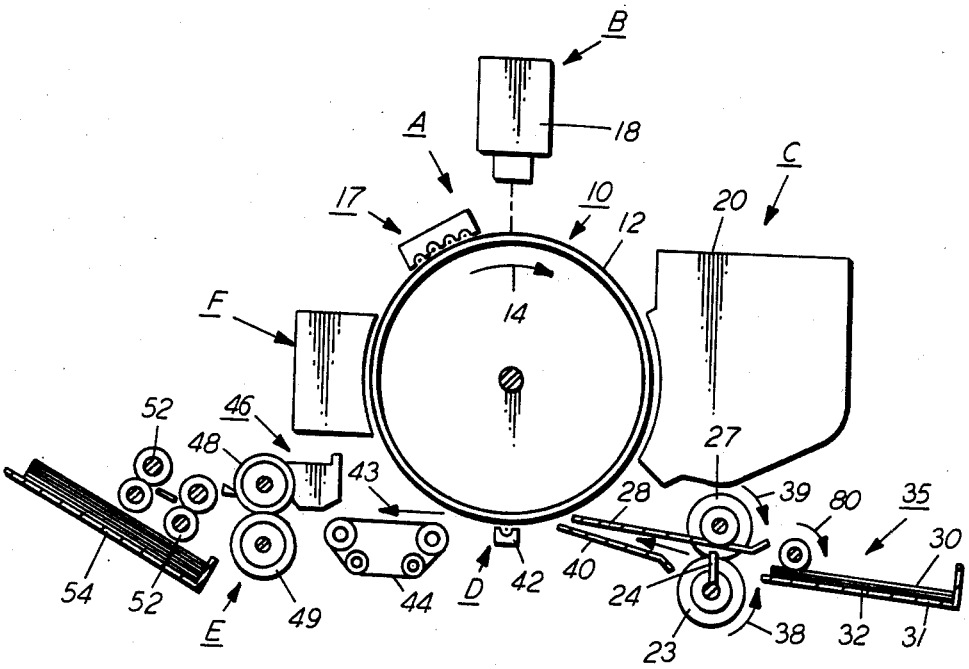
FIG. 1 is a schematic elevational view of an electrophotographic printing machine incorporating the features of the present invention.

For a general understanding of an electrophotographic printing machine in which the features of the present invention may be incorporated, reference is made to FIG. 1 which depicts schematically the various components thereof. Hereinafter, like reference numerals will be employed throughout to designate identical elements. Although the apparatus of the present invention is disclosed as a means for charging a photosensitive member, it should be understood that the invention could be used in an electrophotographic environment as a transfer device also.

Since the practice of electrophotographic printing is well known in the art, the various processing stations for producing a copy of an original document are represented in FIG. 1 schematically. Each process station will be briefly described hereinafter.

As in all electrophotographic printing machines of the type illustrated, a drum 10 having a photoconductive surface 12 entrained about and secured to the exterior circumferential surface of a conductive substrate is rotated in the direction of arrow 14 through the various processing stations. By way of example, photoconductive surface 12 may be made from selenium of the type described in U.S. Pat. No. 2,970,906 issued to Bixby in 1961. A suitable conductive substrate is made from aluminum.

Initially, drum 10 rotates a portion of photoconductive surface 12 through charging station A. Charging station A employs a corona generating device in accordance with the present invention, indicated generally by the reference numeral 17, to charge photoconductive surface 12 to a relatively high substantially uniform potential.

Thereafter drum 10 rotates the charged portion of photoconductive surface 12 to exposure station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the information areas contained within the original document.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 1, a copy sheet is advanced by sheet feeding apparatus 35 to transfer station D. Sheet feed apparatus 35 advances successive copy sheets to forwarding registration rollers 23 and 27. Forwarding registration roller 23 is driven conventionally by a motor (not shown) in the direction of arrow 38 thereby also rotating idler roller 27 which is in contact therewith in the direction of arrow 39. In operation, feed device 35 operates to advance the uppermost substrate or sheet from stack 30 into registration rollers 23 and 27 and against registration fingers 24. Fingers 24 are actuated by conventional means in timed relation to an image on drum 12 such that the sheet resting against the fingers is forwarded toward the drum in synchronism with the image on the drum. A conventional registration finger control system is shown in U.S. Pat. No. 3,902,715 which is incorporated herein by reference to the extent necessary to practice this invention. After the sheet is released by finger 24, it is advanced through a chute formed by guides 28 and 40 to transfer station D.

Continuing now with the various processing stations, transfer station D includes a conventional corona generating device 42 which applies a spray of ions to the back side of the copy sheet. This attracts the toner powder image from photoconductive surface 12 to the copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 45 includes a fuser roll 48 and a backup roll 49 defining a nip therebetween through which the copy sheet passes. After the fusing process is completed, the copy sheet is advanced by conventional rollers 52 to catch tray 54.

Invariably, after the copy sheet is separated from photoconductive surface 12, some residual toner particles remain adhering thereto. Those toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the subject matter of the present invention, FIG. 2 depicts the corona generating device 17 in greater detail.

Figure 2:
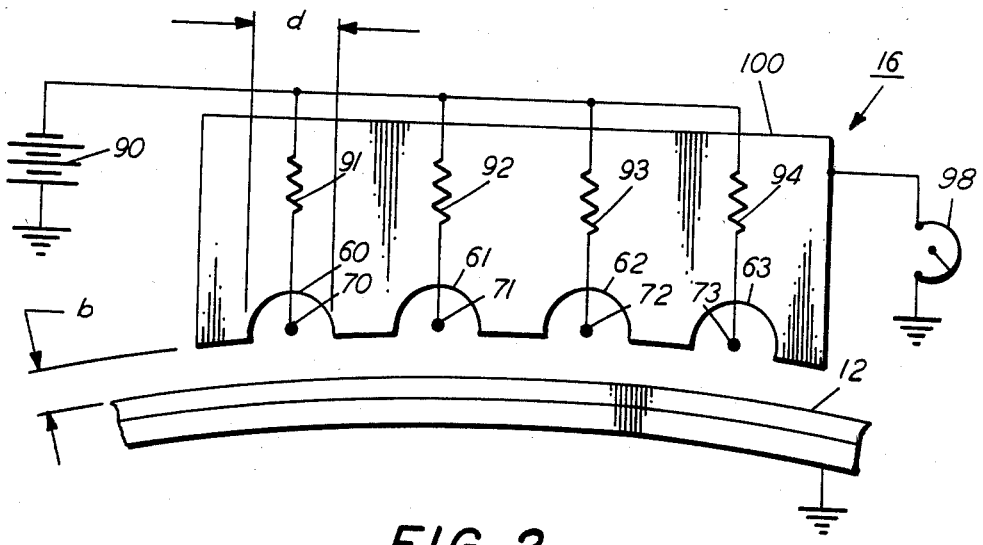
FIG. 2 is an enlarged partial side view of the self limiting mini-corona unit that comprises the present invention.

Referring specifically to FIG. 2, the detailed structure and operation of an aspect of the present invention will be described. The self limiting corona generating unit, generally referred to as 17, is positioned above the photosensitive surface 12 and is arranged to deposit an electrical charge thereon as the surface 12 moves in the clockwise direction. The corona unit includes a series of shield members 60 through 63 which are curvilinear in shape and enclose a substantial portion of corona generator wires 70 through 73 respectively. The shields are preferably made from an electrically conductive material that is biased with respect to ground. A slit or opening is formed in the bottom of each shield opposite the moving photosensitive member and provides a path by which a flow of ions discharged by the generator are directed towards and deposited upon photosensitive surface 12. For further details regarding the structure of a conventional corona unit, reference is had to the disclosure in U.S. Pat. No. 4,112,299 issued to Davis in 1978, which disclosure is incorporated herein to the extent necessary to practice the present invention.

The corona generating wires are connected by suitable means such as an electrical connector to a high potential source or power supply 90. If desired, edge-on metal foils of metalized plastics could be used as alternative corona sources. The corona wire utilized in the present embodiment is connected directly to the positive terminal of the power source whereby positive ion discharge is placed on the photosensitive surface. However, it should be clear that an opposite polarity can be employed to obtain negative discharge. Conventionally, as in U.S. Pat. No. 2,836,725, corona generators have been designed with a cross sectional area of 1" square and use thin wire (0.0035") located about ½" from a shield surrounding the wire and ½" from a receiver surface. Large power supplies for high charging voltages of near 7 KV with a 15" long wire are required for such devices in order to get a current of 22 μA or 1.5 μA/in. In accordance with the present invention the corona generator 17 is fashioned with 0.0015" diameter wire coronodes approximately spaced ¼" from receiver surface 12 and requires only a small sized power supply to get the similar ion output as conventional corona generators. The preferred coronode is a corosion resistant wire of 0.0015" diameter. A coronode of up to 0.0035" diameter can be used but every 0.001" increase in diameter requires an increase of about 200 volts to achieve the same corona output current. These high voltages make suppression of arcing a greater problem.

Mini-corona generator 17 has several advantages over conventional corona generators. For example, it is useful in confined spaces, it can charge over a sharp radius, is useful at the transfer station of a copier as a sheet striping device, charges over a narrow region, i.e., it does not spread the ions out, requires lower current and voltages and gives off less ozone than conventional devices since a lower KV is required for efficient operation and provides control of surface potential on the receptor.

Corona generator 17 enables positive corona generation at about 2.6 KV and comprises a block housing 100 that has a series of semi-cylindrical shields 60, 61, 62 and 63 therein. The shields are about 8½" long and are connected to an adjustable electrical energy source 98 that is adapted to bias the shields. The shields have a radius of about 1/16" and have corona wires 70, 71, 72 and 73 positioned adjacent to and spaced an equal distance from respective shield surfaces while being spaced a distance of approximately ¼" from photosensitive member 12. Resistors 91, 92, 93 and 94 are provided in the wires as a current limiting means in order to further reduce the current to the wires and thereby reduce arcing possibilities. The wires are biased by battery 90 and are adapted to apply an ion charge to the photosensitive surface that is self limiting. For example, if the shields are biased to 1 KV and the wires are biased to 4 KV the surface 12 of the photosensitive member will receive a uniform charge of 1400 KV. To accomplish this control the plurality of shields are spaced much further from the receptor surface 12 than the wire-to-wire shield spacing. Because the surface area of the wires is very small compared to the area of the shields as seen by the receptor, and because the wires are much closer to the shields, the ions between the charge unit and receptor will respond primarily to the fields generated by the potential difference between the shield and the charge receptor. This limits the final surface potential of the charge receptor to a little more than the potential of the shield.

While the invention has been described with reference to the structure herein disclosed, it is not confirmed to the details as set forth and is intended to cover any modifications or changes that may come within the scope of the following claims.

What is claimed is:

1. A self limiting mini-corona generator device for charging a receptor surface, comprising:

a plurality of shield means having a radius of about 1/16" positioned adjacent the receptor surface and means for applying a voltage to said plurality of shields;

corona emission means located within each of said plurality of shields an equal distance from all points on inside surfaces of said plurality of shields while being positioned approximately ¼" from the receptor surface so that the ions from said corona emission means that travel between said plurality of shields and the receptor will respond primarily to the fields generated by the potential difference between said plurality of shields and the receptor surface to thereby limit the surface potential of said receptor surface.

2. The self limiting mini-corona generator device of claim 1, wherein said plurality of shields are semi-cylindrical.

3. A self limiting mini-corona generator device for charging a receptor surface, comprising:

a plurality of shield means each having a radius of about 1/16" and positioned adjacent the receptor surface with means for applying a voltage to said plurality of shields;

corona emission means located within each of said plurality of shields an equal distance from closest points on inside surfaces of said plurality of shields while being positioned farther from the receptor surface than from said shields so that the ions from said corona emission means that travel between said plurality of shields and the receptor will respond primarily to the fields generated by the potential difference between said plurality of shields and the receptor surface to thereby limit the surface potential of said receptor surface.

4. A self limiting mini-corona generator device for charging a receptor surface, comprising:

a plurality of shield means each having a radius of about 1/16" and positioned adjacent the receptor surface with means for applying a voltage to said plurality of shields;

corona emission means located within each of said plurality of shields an equal distance from closest points on inside surfaces of said plurality of shields while being positioned approximately ¼" from the receptor surface so that the ions from said corona emission means that travel between said plurality of shields and the receptor will respond primarily to the fields generated by the potential difference between said plurality of shields and the receptor surface to thereby limit the surface potential of said receptor surface.

5. A mini-corona generator device for charging a receptor surface with self limiting control of potential on said receptor surface, comprising:

a plurality of shield means and means for applying a voltage to said plurality of shields; and a plurality of corona emission means individually located within each of said plurality of shields, each of said corona emission means being connected to a power supply and wherein the distance from each of said corona emission means to said receptor surface is at least about four times the distance from each of said corona emission means to every point on the inside surfaces of said shields.

6. The mini-corona generator device of claim 5, wherein said receptor surface is photoconductive.

7. The mini-corona generator device of claim 6, wherein for negative charging said plurality of shields have a radius of about 3/32".

8. The mini-corona generator device of claim 5, including current limiting means connected between said power supply and each of said corona emission means.

9. A self limiting mini-corona generator device for charging a receptor surface, comprising:

a plurality of shield and means for applying a voltage to said plurality of shields; and a plurality of corona emission means individually located within each of said plurality of shields, each of said corona emission means being connected to a power supply and wherein the distance from each of said corona emission means to said receptor surface is greater than the radius of each of said plurality of shields in order to provide control of the potential on said receptor surface.

* * * * *